US006883537B1

(12) United States Patent
Lin

(10) Patent No.: US 6,883,537 B1
(45) Date of Patent: Apr. 26, 2005

(54) HOSE STORAGE APPARATUS

(76) Inventor: Chien-Hsing Lin, 1048 Debra Dr., Santa Barbara, CA (US) 93110

( * ) Notice: Subject to any disclaimer, the term of this patent is extended or adjusted under 35 U.S.C. 154(b) by 0 days.

(21) Appl. No.: 10/768,140

(22) Filed: Feb. 2, 2004

(51) Int. Cl.[7] ..... B65H 75/34
(52) U.S. Cl. ..... 137/355.16
(58) Field of Search ..... 137/355.16, 355.2, 137/355.23, 355.26, 355.27

(56) References Cited

U.S. PATENT DOCUMENTS

| | | | | |
|---|---|---|---|---|
| 538,950 A | * | 5/1895 | Casson | 137/355.28 |
| 3,939,862 A | * | 2/1976 | Booth | 137/355.16 |
| 4,757,838 A | * | 7/1988 | McGullion | 137/355.27 |
| 5,390,695 A | * | 2/1995 | Howard | 137/355.27 |
| 5,657,789 A | | 8/1997 | Tisbo et al. | |
| 5,704,384 A | | 1/1998 | Tisbo et al. | |
| 5,797,424 A | | 8/1998 | Tisbo et al. | |
| 5,806,814 A | | 9/1998 | White | |
| 5,901,730 A | | 5/1999 | Tisbo et al. | |
| 5,988,552 A | | 11/1999 | Tisbo et al. | |
| 6,059,215 A | | 5/2000 | Finnis | |

* cited by examiner

*Primary Examiner*—Kevin Lee
(74) *Attorney, Agent, or Firm*—Birch, Stewart, Kolasch & Birch, LLP

(57) ABSTRACT

A hose storage apparatus comprising mainly an accommodating mount and a flexible hose. The accommodating mount has a vertical column thereon, and the flexible hose is a coil of hollow tubing curling in a spiral fashion to allow it to wrap around the vertical column when the hose is not in use, and to pull out directly from the top of the vertical column when the hose is in use. Being flexible, the hose may be pulled to extend to a distance. Alternately, the hose automatically retracts to coil on the vertical column due to the recoiling characteristic of the hose, so as to avoid trouble and inconvenience in coiling/uncoiling the flexile hose.

10 Claims, 7 Drawing Sheets

HOSE STORAGE APPARATUS

BACKGROUND OF THE INVENTION

1. Field of the Invention

The invention relates to a hose storage apparatus, and more particularly, to a hose storage apparatus having an accommodating mount and a flexible hose, such that the flexible hose is conveniently pulled out from the accommodating mount for use and retracted automatically to the accommodating mount, in order to avoid trouble and inconvenience for coiling/uncoiling the hose.

2. Description of the Related Art

Many of European and American houses with yards have flowerbeds or gardens. The flowers and plants in these flowerbeds and gardens are maintained by constant watering to provide sufficient moisture for plant life and growth. For a simple flowerbed, plants may be watered with a simple sprinkler supplied by a short, fixed hose. But for a large garden setting, large-scale watering is usually required using a long hose to ensure all plants in the garden have sufficient water.

Typically, while the hose is used to carry out watering, the hose can tangle easily when it is uncoiled and pulled out to a long distance. As the hose is extended out, it can tangle into knots, making it difficult to pull the hose to a distance for watering. Furthermore, the hose can bind so as to restrict water flow in the hose, similarly making watering at a distance difficult. So, it is not convenient to carry out watering using the conventional hose, especially for watering a large garden.

After watering is completed, the long hose usually has to be carefully coiled into a coil for storage. However, careless coiling of the hose easily results in tangling when the hose is later uncoiled to be used again. Therefore, it is inconvenient to carry out watering using the hose, and improvements are needed to facilitate better coiling/uncoiling of the hose.

To resolve the inconvenience for coiling and uncoiling the hose, a conventional hose reel 6 has been proposed as shown in FIG. 6 for coiling/uncoiling the hose 5. The conventional hose reel 6 has a reel body 61 that is formed with a rotatable coiling barrel 62 thereon. On one side of the coiling barrel 62, a crank handle 63 or a mechanism (not shown) for rotating the coiling barrel 62 is further formed co-axial to the coiling barrel 62. The hose 5 has one end fixed to the coiling barrel 62, such that the hose is coiled on the coiling barrel 62 by rotating the coiling barrel 62 with the crank handle 63. And the hose 5 is uncoiled by simply pulling out the hose 5 from the coiling barrel 62, making it convenient to water the garden without the trouble associated with directly pulling the hose 5. It is noted that the conventional hose reel 6 described above is also disclosed in several U.S. patents, including U.S. Pat. Nos. 5,657,789, 5,704,384, 5,797,424, 5,901,730, and 5,988,552.

Although the hose 5 is coiled/uncoiled conveniently with the hose reel 6, the hose reel 6 is a coiling mechanism having a complex structure. So, cost for the hose reel 6 is usually high for the typical consumers.

Also, as the coiling barrel 62 is rotated with the hand-held crank handle 63 for coiling the hose 5, a large amount of manual labor is expended to coil a long hose 5. Another mechanism (not shown) that enables rotation of the coiling barrel 62 may be included to substitute for the manual coiling structure. However, an additional mechanism means the entire structure of the hose reel 6 is made more complex than a simplified structure having simply the crank handle 63. Accordingly, the cost for fabricating the hose reel 6 with a crank handle 63 and the additional mechanism is further increased, making such a hose reel structure less attractive to the general consumer.

As shown in FIG. 7, a hose rack 7 for easy coiling/uncoiling of the hose 5 is further disclosed in U.S. Pat. No. 6,059,215, while a similar structure is disclosed in U.S. Pat. No. 5,806,814. The hose rack 7 is a metal rack body, which is directly attached to a wall or post, so that the hose 5 can be directly coiled on the hose rack 7.

However, the hose 5 has to be held by the user's hand and wrapped around the hose rack 7. Also, the hose 5 is made of soft material, so it is difficult to coil the hose 5 evenly on the hose rack 7 after the hose 5 is wrapped around the hose rack 7. Furthermore, if the hose 5 needs to be used again, it has to be uncoiled loop by loop from the rack. When the hose 5 is uncoiled, it is very likely to cause twisting of the hose 5 into a knot. Therefore, it is inconvenient to uncoil the hose 5 as it easily tangles. As a result, the above-mentioned drawbacks are not adequately resolved and require further improvements.

SUMMARY OF THE INVENTION

The primary objective of the present invention is to provide an apparatus for conveniently coiling/uncoiling a flexible hose on an accommodating mount, so as to avoid trouble and inconvenience for coiling and uncoiling a water hose.

Another objective of the present invention is to provide a hose storage apparatus, comprised mainly of a flexible hose and an accommodating mount, wherein the flexible hose is a coil of hollow tubing curling in a spiral fashion, such that the flexible hose is flexible in terms of retraction and extension to be conveniently stored on the accommodating mount.

Another objective of the present invention is to provide a hose storage apparatus comprising the flexible hose and the accommodating mount, wherein the flexible hose retracts as a result of its spiral-coiled shape, such that the flexible hose is merely pulled to extend the hose by an applied force without using other mechanical structures, simplifying the structure and reducing the fabrication cost.

Another objective of the present invention is to provide a hose storage apparatus having a flexible hose that retracts and extends as a result of its spiral-coiled structure to prevent tangling of the hose, so as to save trouble when adjusting the hose in use.

Another objective of the present invention is to provide a hose storage apparatus having a flexible hose that retracts and extends as a result of its structure, so as to prevent pinching of the hose caused by tangling of the hose resulting a retarded water flow.

In accordance with the above and other objectives, the present invention proposes a hose storage apparatus comprising an accommodating mount and a flexible hose. The accommodating mount has a vertical column, and the flexible hose is a spiral-coiled hollow tube, such that the flexible hose is coiled by its natural curling structure on to the vertical column of the accommodating mount when the flexible hose is not used, and the flexible hose is directly pulled out by pulling the flexible hose from a top of the vertical column to a distance. And, as soon as the flexible hose is released, the flexible hose retracts due to its recoiling characteristic to coil on the vertical column of the accommodating mount, so as to save time and trouble in coiling/uncoiling the flexible hose.

To provide a further understanding of the invention, the following detailed description illustrates embodiments and examples of the invention. It is to be understood that this detailed description is being provided only for illustration of the invention and not to limit the scope of this invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
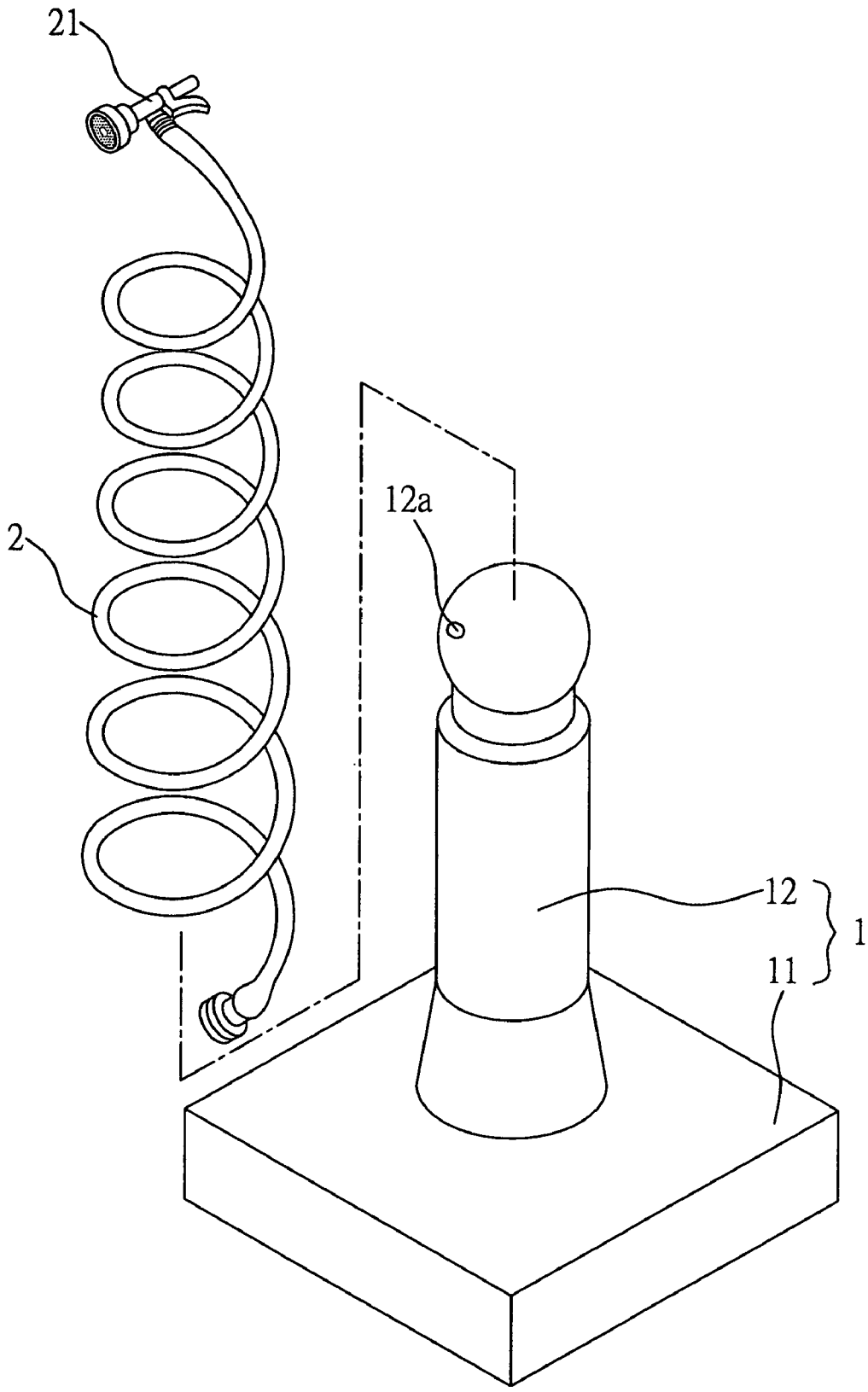
FIG. 1 is an exploded view of a hose storage apparatus according to one preferred embodiment of the present invention.
Figure 2:
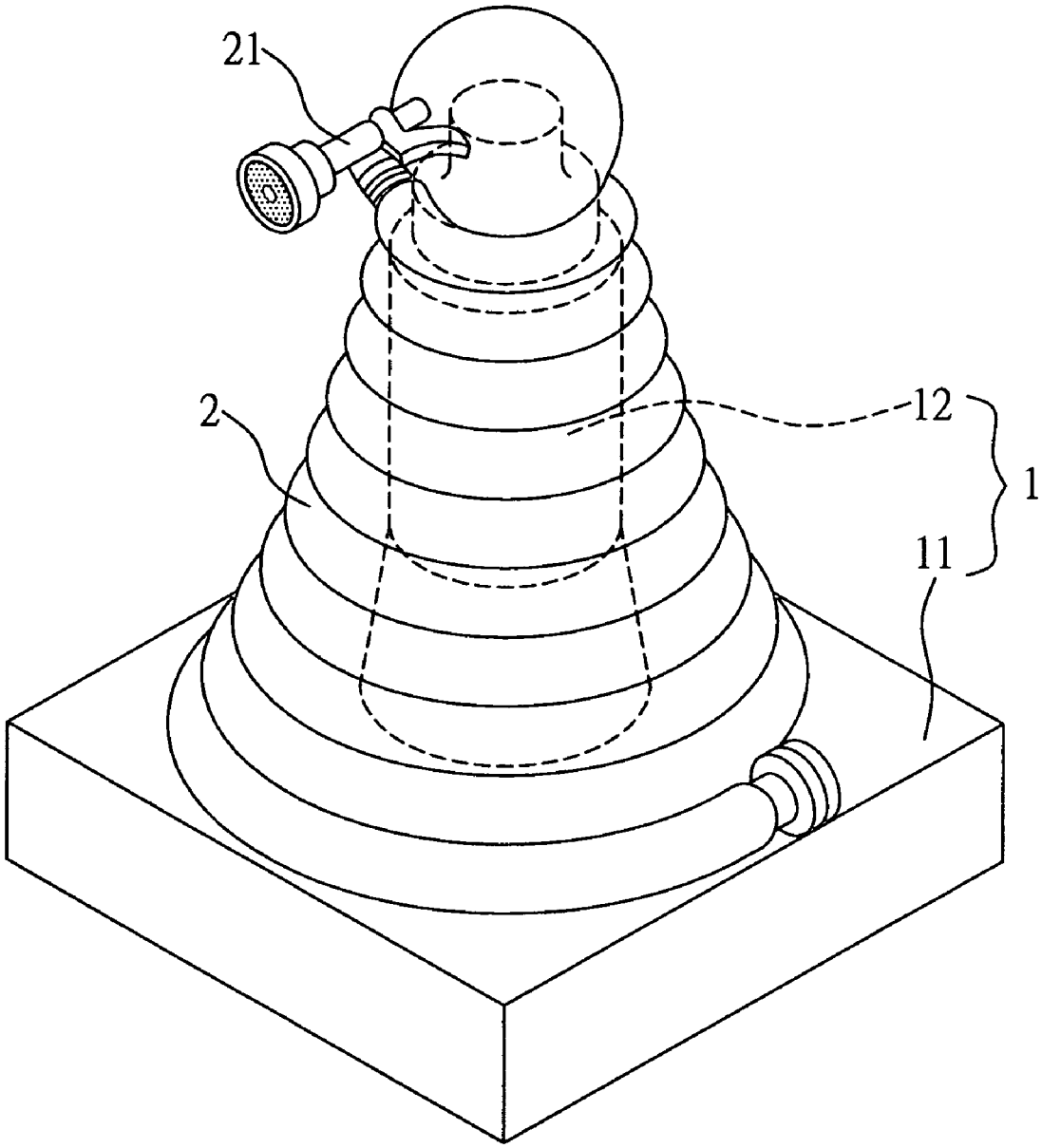
FIG. 2 is a perspective view of the hose storage apparatus of the hose storage apparatus according to one preferred embodiment of the present invention.

Referring to FIG. 1, a hose storage apparatus comprises an accommodating mount 1 and a flexible hose 2. The accommodating mount 1 includes a base 11 provided with a vertical column 12 thereon. The flexible hose 2 is a spiral-coiled hollow tube that can coil on the vertical column 12 of the accommodating mount 1 as shown in FIG. 2.

Since the flexible hose 2 has a spiral-coiled hollow tube structure, the flexible hose is free to extend and retract. And, when usage for watering is desired, the flexible hose 2 is uncoiled from the accommodating mount 1, such that one end of the flexible hose 2 is connected to a tap outlet and the other end of the flexible hose 2 can be pulled to a distance. When the flexible hose 2 is elongated by pulling, its appearance changes to a shape similar to an extended spring, so that the flexible hose 2 may be pulled to a distance to carry out watering. When watering is complete, the flexible hose is released to readily recoil into its original shape. Next, the flexible hose 2 is removed from the tap and coiled on the vertical column 12 of the accommodating mount 1 in order to complete the operation of coiling/uncoiling the flexible hose 2.

The flexible hose 2 achieves flexible extension via its spiral-coiled structure. Thus, this property saves time and trouble for storing the flexible hose 2 over using the conventional coiling barrel of the prior art. The flexible hose 2 is automatically recoiled by lightly adjusting the flexible tube by hand, making it convenient and ready for the next usage.

Since the flexible hose 2 achieves extension and retraction via its spiral-coiled structure, and the accommodating mount 1 is merely an accommodating structure without any other moving mechanisms, the entire structure for the hose storage apparatus is simplified, lowering its manufacture cost. And a lower manufacturing cost usually makes the hose storage apparatus more popular and acceptable with general consumers.

Further, the flexible hose 2 has a spiral-coiled structure that enables a self-recoiling. So, this prevents tangling of the flexible hose 2, saving time spent on adjusting the hose employed in the prior art during usage. As a result, it is more practical and convenient to use the flexible hose 2 than the conventional hose.

Moreover, as the flexible hose 2 achieves extension by its spiral-coiled structure, the flexible hose 2 needs to be composed of material with sufficient hardness. Since the flexible hose 2 is composed of the hard material, the diameter of the flexible hose 2 is not easily flattened under compression. This prevents retardation of water flow due to tangling of the hose. Therefore, it is more convenient for the user to water at a distance, since the user doesn't need to continually monitor and adjust for tangling when moving around.

In usage, one end of the flexible hose 2 is mounted with a nozzle 21. And, depending on the actual situation, different types of nozzles 21 may be used to cause the water to eject in various manners, including a single jet, multiple fine jets, or mist.

Alternatively, the flexible hose 2 may be a spiral and cylindrical coiled hollow tube to achieve a similar effect as the spiral-coiled hollow tube previously discussed.

Figure 3:
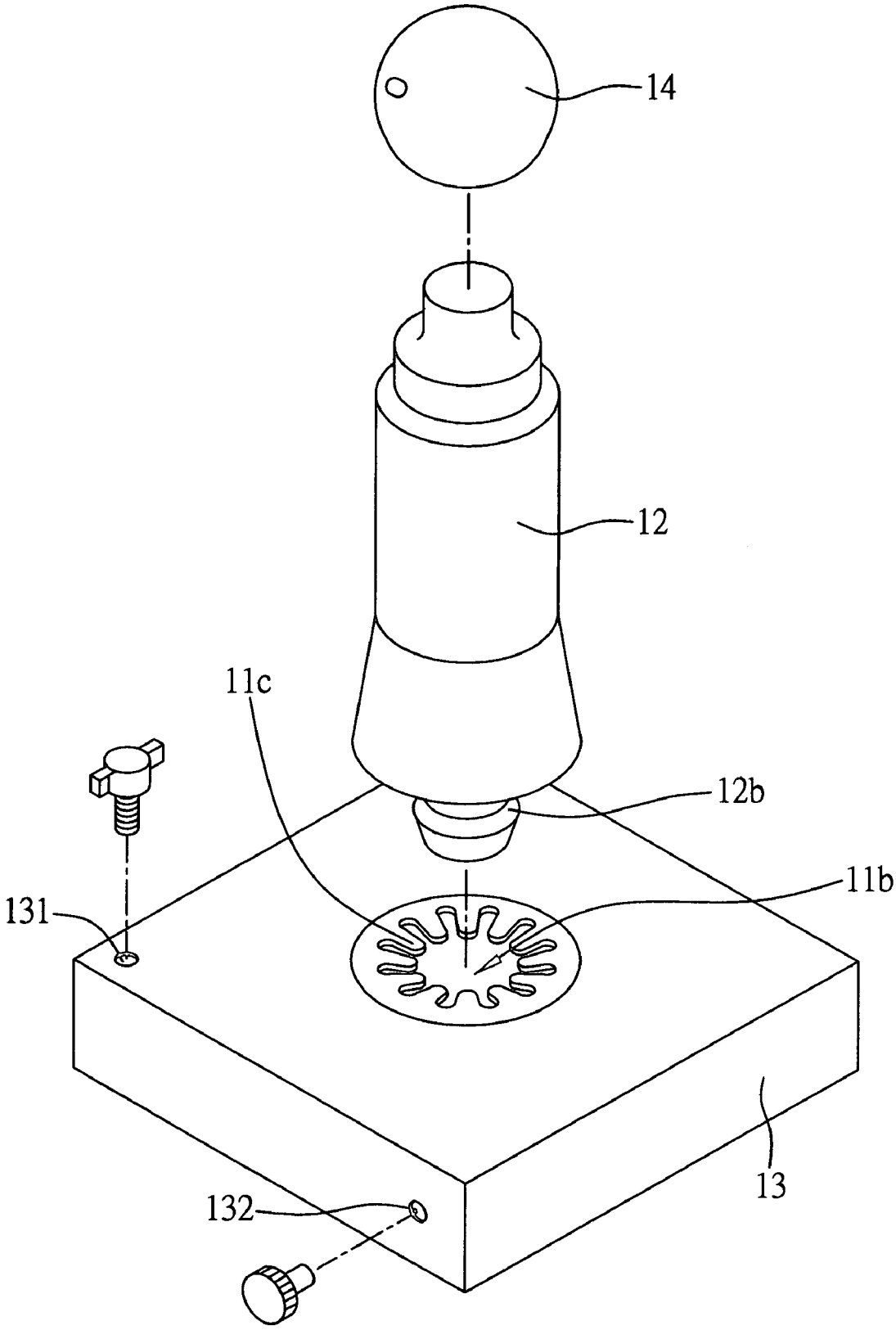
FIG. 3 is an exploded view of an accommodating mount according to one preferred embodiment of the present invention.

Referring to FIG. 3, a bottom of the accommodating mount 1 is a hollow base 13 for securing the vertical column 12 thereon, and the hollow base 13 is further formed with a water inlet 131 and a discharge outlet 132, so that the hollow base 13 may be filled up with water via the water inlet 131. As a result, this provides storage stability to prevent tipping of the accommodating mount 1. And if the hose storage apparatus is to be moved to other places, water in the hollow base 13 may be discharged from the discharge outlet 132 to reduce the weight of the accommodating mount 1, making the hose storage apparatus easier to be moved to another place.

Figure 4:
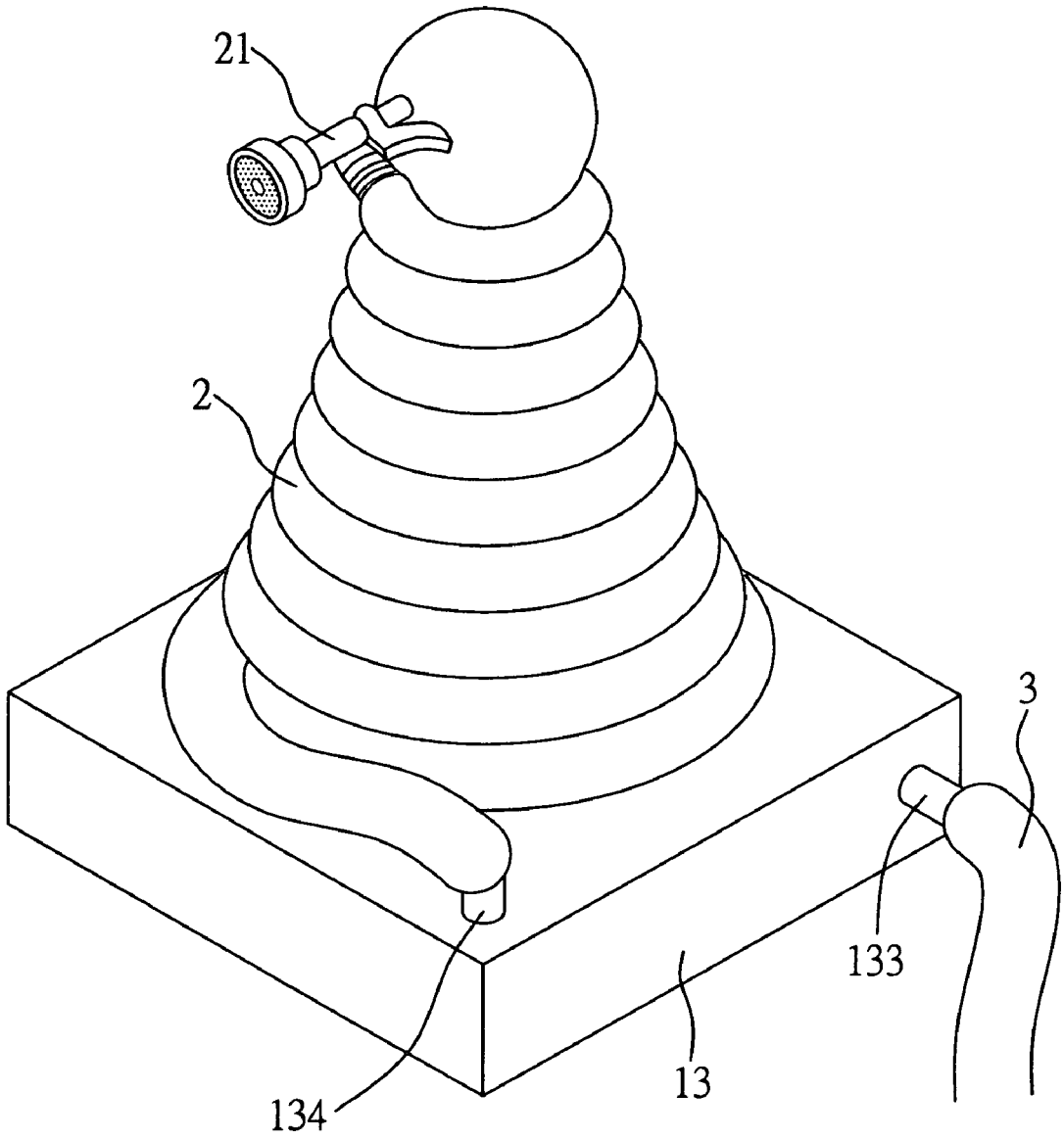
FIG. 4 is a perspective view of the hose storage apparatus according to another embodiment of the present invention.

In another embodiment, referring to FIG. 4, a water inlet 133 and a discharge outlet 134 are further formed on the hollow base 13, wherein the water inlet 133 is connected to a tap (not shown) by another hose 3, and the discharge outlet 134 is connected to the flexible hose 2, such that water is introduced into the hollow base 13 to fill up and stabilize the accommodating mount 1. Then, water is supplied from the hollow base 13 to the flexible hose 2 in such a way that the flexible hose 2 and accommodating mount 1 are integrated as one body, so as to save trouble in connecting the flexible hose 2 to the tap each time the apparatus is used. And, such a structural arrangement is also applicable to the embodiment where the hose storage apparatus is used by fixing it to the ground for use over an extended period.

When the hose storage apparatus is used for an extended period, the hose 3 supplying the hollow base 13 is detached from the water inlet 133 after usage, so that water in the hollow base 13 drains from the water inlet 133. Hence, this makes it easier to move the host storage apparatus after water in the hollow base 13 is emptied.

Figure 5:
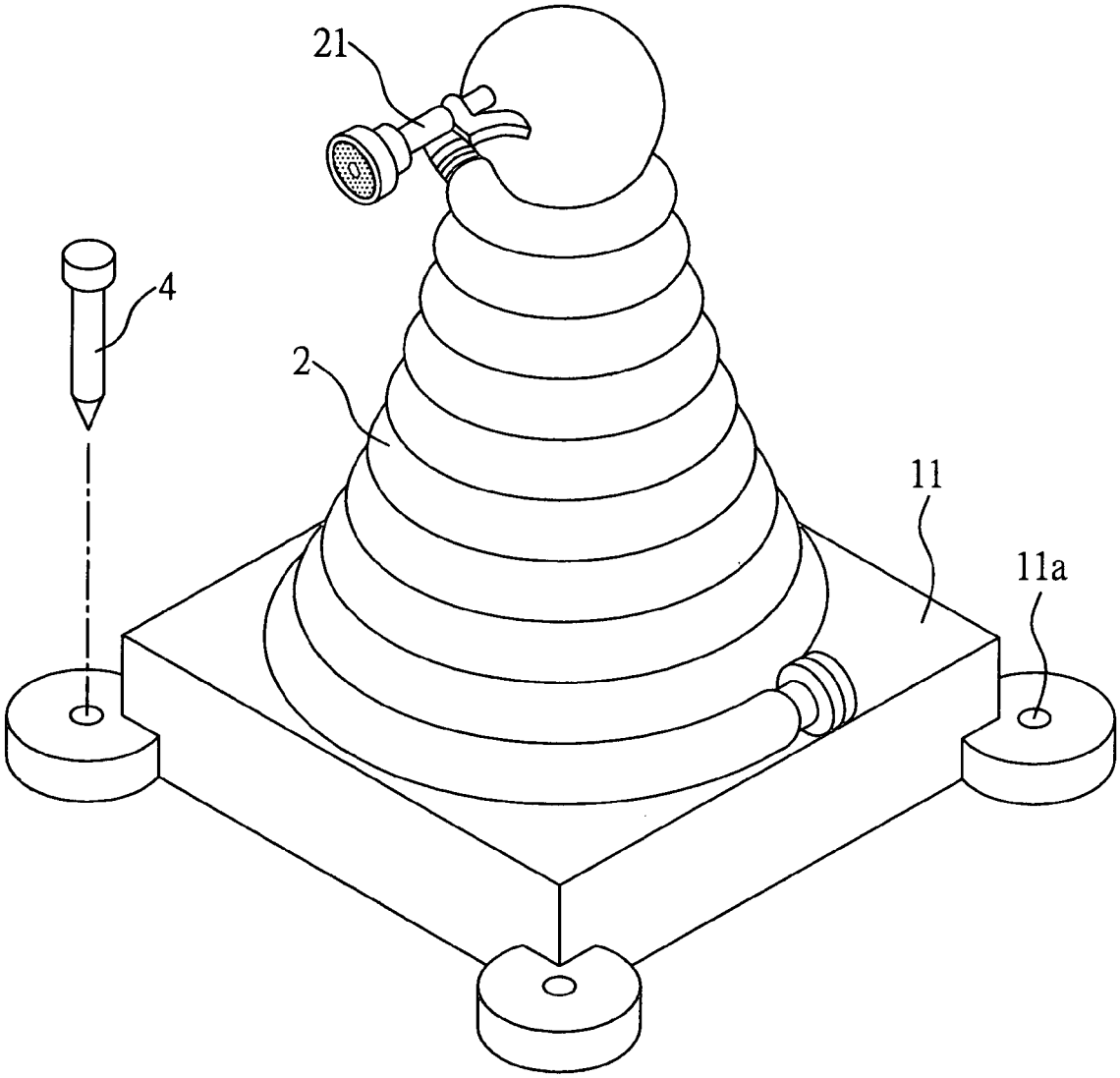
FIG. 5 is a perspective view of the accommodating mount of the hose storage apparatus according to another embodiment of the present invention.
Figure 6:
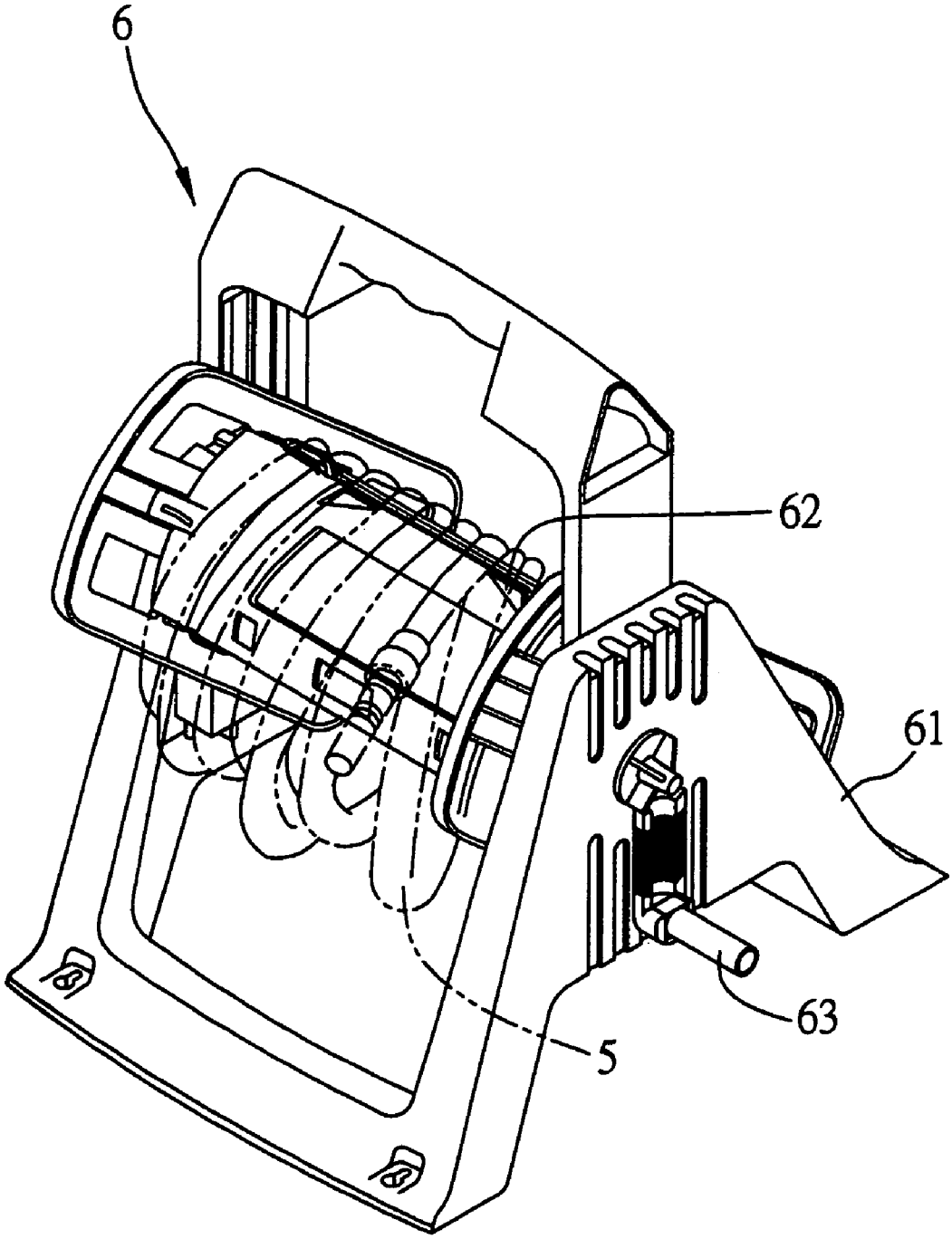
FIG. 6 is a perspective view of conventional hose reel according to U.S. Pat. No. 5,657,789.
Figure 7:
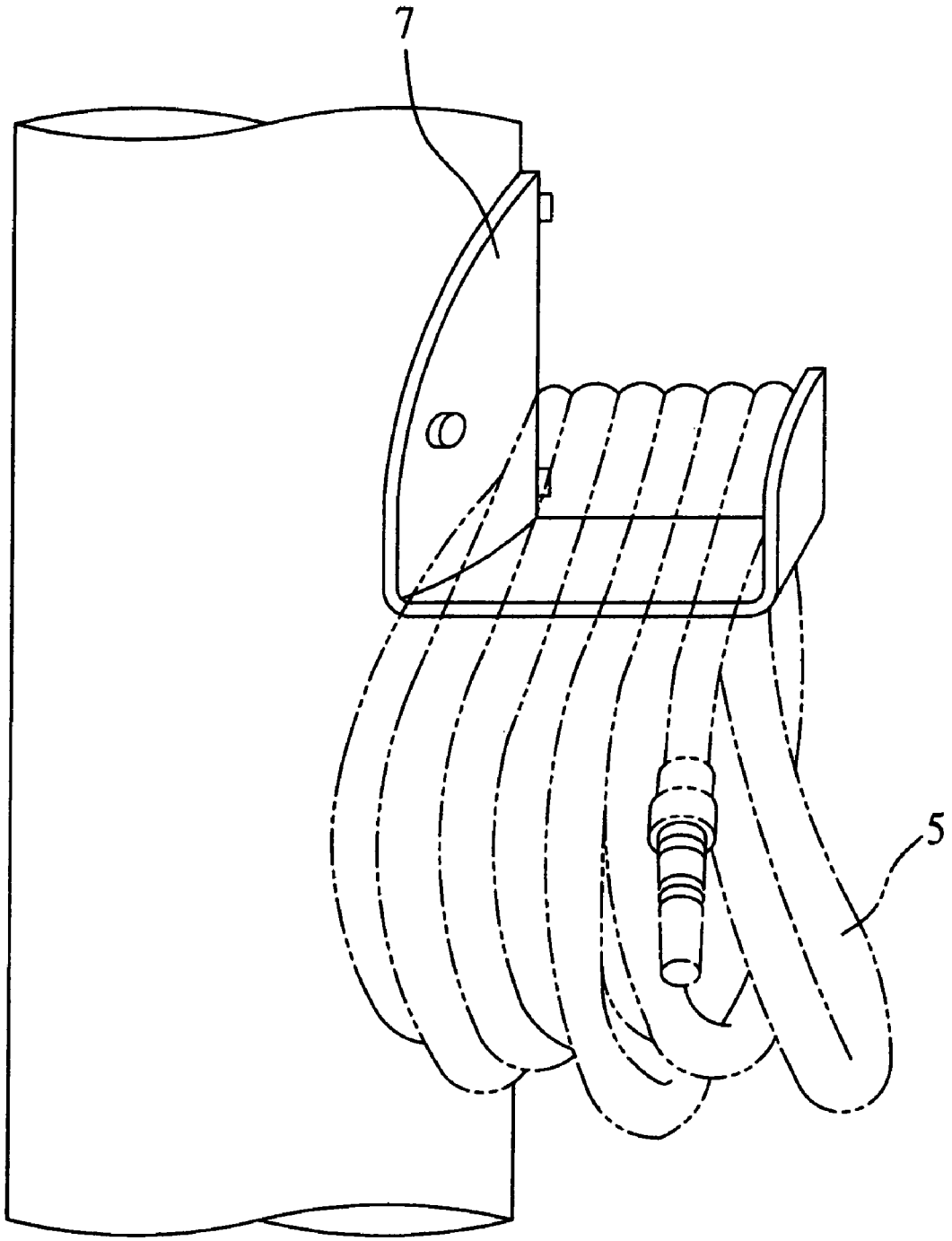
FIG. 7 is a perspective view of conventional hose rack according to U.S. Pat. No. 6,059,215.

Referring to FIG. 5, a base 11 is formed below the accommodating mount 1, and a plurality of fastening holes 11*a* are further formed around the perimeter of the base 11 in such a manner that the accommodating mount 1 may be securely staked to the ground via insertion of stakes 4 through the fastening holes 11*a*. If the ground is composed of cement, the accommodating mount may be permanently fixed to the ground (permanent fixation of the accommodating mount 1 to the cement ground is not the key point of the present invention, so the details are omitted herein). And if the ground is a lawn, the accommodating mount 1 may be fixed temporarily so as to prevent tipping of the accommodating mount 1.

It is noted that the present embodiment is also applicable to the accommodating mount 1 having either the base 11 or the hollow base 13 formed at the bottom of the accommodating mount 1.

Again, referring to FIG. 1, a carrier base 12*a* is further formed on top of the vertical column 12 of the accommodating mount 1 for receiving the nozzle 21 connected to the end of the flexible hose 2.

Referring to FIG. 3, on the base 11 (or hollow base 13) of the accommodating mount 1, a through hole 11*b* is formed, through which the vertical column 12 can be inserted and secured. Thus, the vertical column 12 can be detached from the base 11 (or hollow base 13) to minimize the overall size, making it easier for packing and moving the host storage apparatus.

Moreover, a protrusion piece 1*c* is formed on an inner circumferential face of the through hole 11*b*. Correspondingly, a circumferential groove 12*b* is formed at a bottom end of the of the vertical column 12, so that the vertical column 12 may be securely fixed on the base 11 (or hollow base 13) by engaging the protrusion piece 11*c* of the through hole 11*b* to the circumferential groove 12*b* of the vertical column 12 when the bottom end of the vertical column 12 is inserted in the through hole 11*b* of the base 11 (or hollow base 13). Accordingly, such assembly also facilitates detachment of the vertical column 12 from the base (or hollow base 13).

Further referring to FIG. 3, a detachable top cap 14 is mounted on the top of the vertical column 12 for securing the flexible hose 2 on the accommodating mount 1. The detachable top cap 14 is removed from the top of the vertical column 12 before the flexible hose 2 can be uncoiled from the vertical column 12. And after usage of the flexible hose 2, the flexible hose 2 is coiled back on the vertical column 12 before mounting the detachable top cap 14 on the top of the vertical column 12. As a result, the flexible hose 2 is clamped on the vertical column 12 between the base 11 (or hollow base 13) and detachable top cap 14 respectively at the bottom end and the top end of the vertical column 12, so as to prevent the flexible hose 2 from lying loosely on the ground.

It should be apparent to those skilled in the art that the above description is only illustrative of specific embodiments and examples of the invention. The invention should therefore cover various modifications and variations made to the herein-described structure and operation of the invention, provided they fall within the scope of the invention as defined in the following appended claims.

What is claimed is:

1. A hose storage apparatus, comprising:

an accommodating mount having a vertical column;

a hollow base formed at a bottom of the accommodating mount for mounting the vertical column, wherein the hollow base is formed with a water inlet and a discharge outlet, such that the hollow base is filled up with water via the water inlet to stabilize the accommodating mount; and a flexible hose for flexibly coiling on the vertical column, such that the flexible hose is extended flexibly to a distance and is retracted on the vertical column.

2. The hose storage apparatus of claim 1, wherein the flexible hose is a spiral-coiled hollow tube.

3. The hose storage apparatus of claim 1, wherein the flexible hose is a spiral and cylindrical coiled hollow tube.

4. The hose storage apparatus of claim 1, wherein a nozzle is further formed at an end of the flexible hose.

5. The hose storage apparatus of claim 1, wherein the water inlet is connected to a water source and the discharge outlet is connected to the flexible hose, so as to allow the flexible hose to tap water from the water source.

6. The hose storage apparatus of claim 1, wherein the accommodating mount is formed with one or more fastening holes, so that the accommodating mount is fastened to the ground by driving stakes through the fastening holes.

7. The hose storage apparatus of claim 4, further including a carrier platform formed on top of the vertical column for receiving the nozzle at the end of the flexible hose.

8. The hose storage apparatus of claim 1, wherein a through hole is formed on a base of the accommodating mount, to allow insertion of the vertical column.

9. The hose storage apparatus of claim 8, wherein a protrusion piece is formed on an inner circumferential face of the through hole, and a circumferential groove is formed at a bottom end of the vertical column, such that the vertical column is stably secured to the base by engaging the protrusion piece with the circumferential groove.

10. The hose storage apparatus of claim 7, wherein a detachable top cap is mounted on top of the vertical column for clamping the flexible hose via the nozzle on the vertical column.

* * * * *